United States Patent [19]

Miller

[11] Patent Number: 5,039,059

[45] Date of Patent: Aug. 13, 1991

[54] WALER BRACKET FOR CONCRETE FORMING STRUCTURE

[75] Inventor: Michael J. Miller, Medinah, Ill.

[73] Assignee: Symons Corporation, Des Plaines, Ill.

[21] Appl. No.: 587,607

[22] Filed: Sep. 24, 1990

Related U.S. Application Data

[63] Continuation of Ser. No. 348,904, May 8, 1989, abandoned.

[51] Int. Cl.[5] ..... E04G 17/04

[52] U.S. Cl. ..... 249/196; 249/18; 249/47; 249/219.2

[58] Field of Search ..... 249/1, 13, 18, 33, 44, 249/47, 166, 196, 219.2, 192–195

[56] References Cited

U.S. PATENT DOCUMENTS

| | | | |
|---|---|---|---|
| 953,383 | 3/1910 | Holman | 249/219.2 |
| 2,782,483 | 2/1957 | DeCanio | 249/219.2 |
| 2,782,484 | 2/1957 | DeCanio | 249/219.2 |
| 3,206,823 | 9/1965 | Walter | 249/1 |
| 3,728,838 | 4/1973 | Stout | 249/18 |

FOREIGN PATENT DOCUMENTS

| | | | |
|---|---|---|---|
| 2906800 | 8/1980 | Fed. Rep. of Germany | 249/18 |
| 679497 | 9/1952 | United Kingdom | 249/219.2 |

*Primary Examiner*—James C. Housel
*Attorney, Agent, or Firm*—Charles F. Meroni, Jr.

[57] ABSTRACT

In a concrete forming structure for forming residential concrete including a series of upright side-by-side positioned forming panels of the type having a face sheet and I-beams secured thereto at margins of the face with adjacent I-beams on adjacent panels co-acting to act as siderails, the I-beams carrying vertically spaced bushings, and with the panels having wedge bolts extending through aligned bushings securing the panels in assembly together, one piece waler brackets mounted on the siderails in horizontally spaced relation for carrying horizontal lengths of lumber which comprise alignment walers, each of the waler brackets including a horizontal waler bracket leg and an upright bracket leg secured in fixed assembly to the horizontal waler bracket leg at a point spaced from an inner end of the horizontal waler bracket leg, an L-shaped bracket angle fixedly attached to the horizontal waler bracket leg and cooperable therewith to define a U-shaped rearwardly facing channel, and a wedge bolt fixedly secured to the horizontal waler leg inwardly of the channel with the wedge bolt being positioned rearwardly of the U-shaped rearwardly facing channel, the wedge bolt being extendable through one of the bushings and with the one piece waler bracket being rotatable in unison with the wedge bolt when the wedge bolt is engaged in the bushing to rotate the U-shaped rearwardly facing channel into engaged relation with an outer edge of the siderails in locked engagement with three confronting siderail faces of the siderails.

20 Claims, 3 Drawing Sheets

FIG. 8
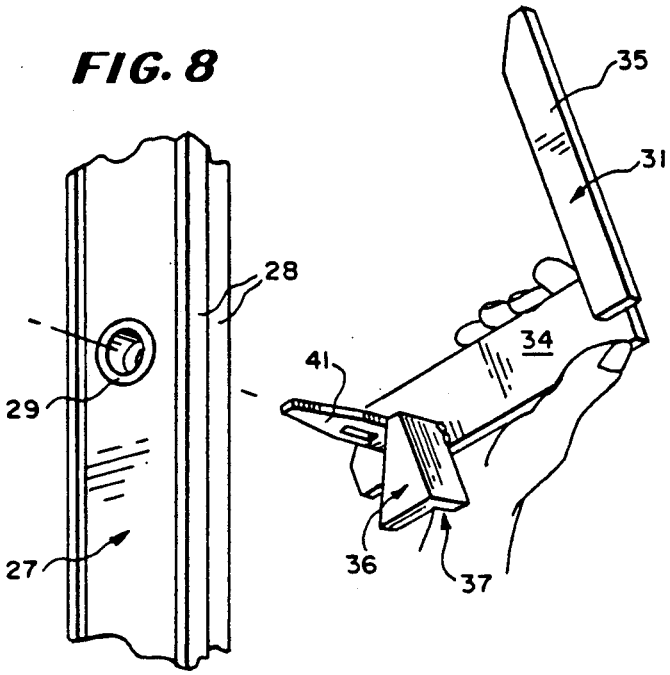
FIG. 9
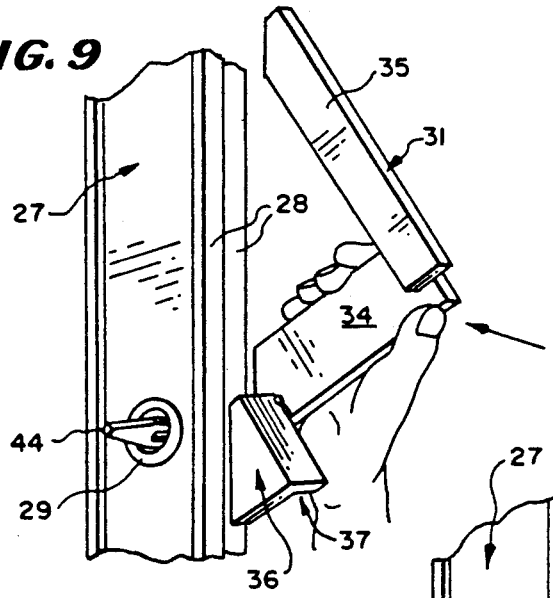
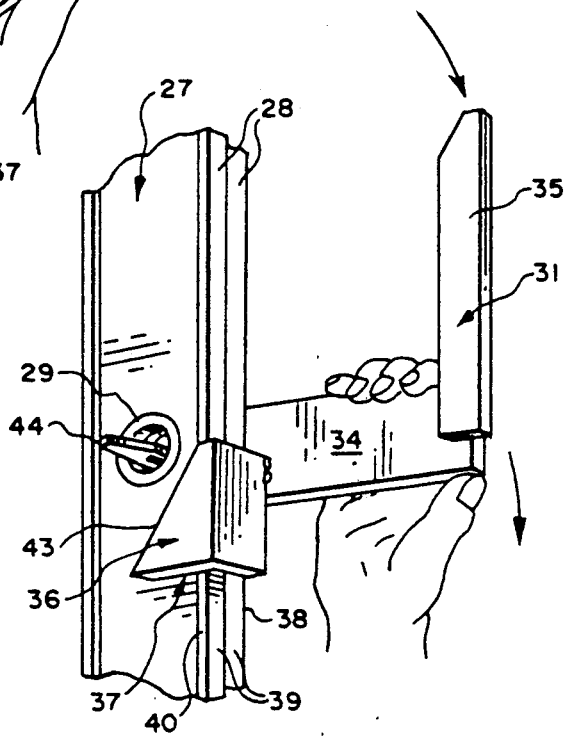
FIG. 10

WALER BRACKET FOR CONCRETE FORMING STRUCTURE

This is a continuation of copending application(s) Ser. No. 07/348,904 filed on 5/8/89, and now abandoned.

FIELD OF THE INVENTION

The present invention is concerned with a new and improved waler bracket for concrete forming structure. More specifically it is concerned with a lightweight concrete forming structure using three foot wide panels for forming residential concrete in the form of concrete walls. The concrete forming structure is pre-engineered, reusable and factory built. The new improved concrete forming structure is easy to set up and easy to strip. No measuring, sawing, drilling or nailing is required. A minimum amount of training is required in order to use this system, so workers are quickly up to maximum efficiency.

In the past, concrete forming structures have been provided with waler brackets for attachment to the siderails on the concrete forms for supporting lumber walers which align the forms. The waler brackets that have been used in the past have been identified as the so-called "C" bracket which is of various standard sizes such as 2"×4", 2"×6" or 2"×8". This older type of "C" bracket has required additional pins or wedges in order to secure the bracket to the waler. In accordance with my invention, I have developed a new and improved so-called "M" waler bracket of a one piece construction which requires no additional pins or wedges for mounting the bracket on the siderails of a concrete forming structure for carrying lumber walers thereon. This one piece "M" waler bracket is easier to remove for only one part needs to be removed by first rotating the bracket upwardly to free its channel from engagement from the siderail and then moving the bracket sideways to disengage its wedge bolt from a bushing through the siderail. These procedure of assembly and disassembly can be easily accomplished with one hand while an installer is on a ladder as compared to all other brackets known to me after many years of experience in the construction industry.

Heretofore, various different types of brackets have been used for the purpose of mounting walers on concrete forms. One such system that has been widely used is shown in FIGS. 1 and 2 of the patent drawings of this application. It is believed that the waler bracket shown in FIGS. 1 and 2 represents the state of the art concerning brackets of this type prior to my invention. This bracket assembly requires three (3) parts to complete assembly and disassembly.

SUMMARY OF MY INVENTION

In a concrete forming structure for forming residential concrete where the components thereof can be easily and quickly assembled on the job including a series of upright side-by-side positioned forming panels of the type having a face sheet and I-beams secured thereto at margins of the face with adjacent I-beams on adjacent panels coacting to act as siderails, the I-beams carrying vertically spaced bushings, and with the panels having wedge bolts extending through aligned bushings securing the panels in assembly together, the improvement of one piece waler brackets mounted on the siderails in horizontally spaced relation for carrying horizontal lengths of lumber which comprise alignment walers, each of the waler brackets including a horizontal waler bracket leg and an upright bracket leg secured in fixed assembly to the horizontal waler bracket leg at a point spaced from an inner end of the horizontal waler bracket leg, an L-shaped bracket angle fixedly attached to the horizontal waler bracket leg and cooperable therewith to define a U-shaped rearwardly facing channel, and a wedge bolt fixedly secured to the horizontal waler leg inwardly of said channel with the wedge bolt being positioned rearwardly of the U-shaped rearwardly facing channel, the wedge bolt being extendable through one of the bushings and with the one piece waler bracket being rotatable in unison with the wedge bolt when the wedge bolt is engaged in the bushing to rotate said U-shaped rearwardly facing channel into engaged relation with an outer edge of the siderail in locked engagement with three confronting siderail faces of the siderails.

A one piece waler bracket for mounting on an I-beam in horizontally spaced relation to other waler brackets for carrying horizontal lengths of lumber which provide alignment, the waler bracket including a horizontal waler bracket leg and an upright bracket leg secured in fixed assembly to the horizontal waler bracket leg at a point spaced from an inner end of the horizontal waler bracket leg, an L-shaped angle fixedly attached to the horizontal waler bracket leg and cooperable therewith to define a U-shaped rearwardly facing channel, and a wedge bolt fixedly secured to the horizontal waler leg inwardly of the channel with the wedge bolt being positioned rearwardly of the U-shaped rearwardly facing channel, the wedge bolt being extendable through bushing on a waler and with the one piece waler bracket being rotatable in unison with the wedge bolt when the wedge bolt is engaged in a bushing to rotate the U-shaped rearwardly facing channel for locked engagement with three confronting faces of siderails, the wedge bolt being positioned above and rearwardly of where said L-shaped angle is fixedly secured to the horizontal waler bracket leg.

According to the features of my invention the wedge bolt is positioned above and rearwardly of where the L-shaped angle is fixedly secured to said horizontal waler bracket leg.

Still other features of my invention relate to the L-shaped angle which extends beneath the horizontal waler bracket leg thereby vertically extending the effective length of the U-shaped channel for locking engagement with the siderails.

Yet other features of my invention relate to the L-shaped angle being provided with an outer angle leg extending parallel to the horizontal waler bracket leg, the outer angle leg having a bevelled outer edge spaced inwardly at its upper end from the wedge bolt and having a lower end spaced beneath in underlying relation to the wedge bolt leaving a clearance between the L-shaped angle allowing the waler bracket to freely rotate on said wedge bolt in a bushing free of interference with a waler when associated therewith.

Other and still further features of my invention relate to the horizontal waler bracket leg having a hole in it and with said wedge bolt being extended through said hole and means fixedly attaching said wedge bolt and said horizontal waler bracket leg in fixed engagement together.

BRIEF DISCUSSION OF THE DRAWINGS

FIG. 8 is an enlarged fragmentary illustrative view showing the way in which my new and improved waler bracket can be assembled with the siderails.

FIG. 9 is an enlarged fragmentary view similar to FIG. 8 only showing the waler bracket in an intermediate stage of assembly with the siderails; and FIG. 10 is an enlarged fragmentary perspective view similar to FIGS. 8 and 9 showing the way that the waler bracket can be finally assembled with the siderails by using one hand and without any need for wedge bolts or additional pins to hold the wedge fastener or bolt in place on the siderails.

DESCRIPTION OF THE PREFERRED EMBODIMENT

Figure 1:
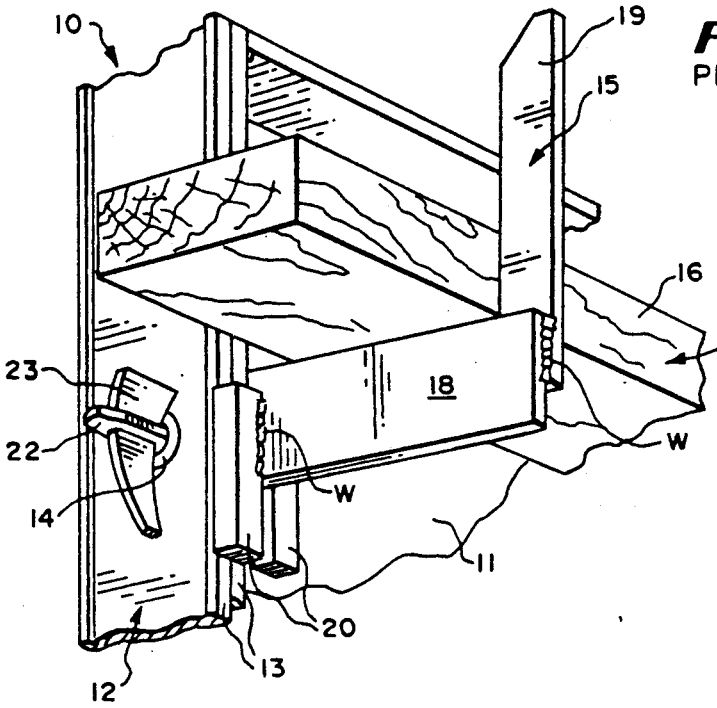
FIG. 1 PRIOR ART
FIG. 1 is a perspective view of a prior art type of concrete forming system illustrating the type of bracket that is commonly used in industry today for supporting alignment walers on the concrete forming structure.
Figure 2:
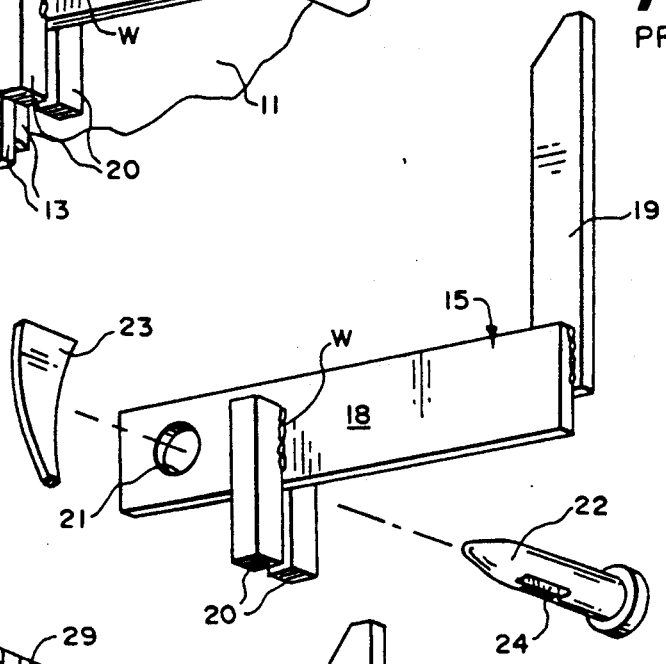
FIG 2 PRIOR ART
FIG. 2 is an enlarged exploded view showing the way in which the prior art brackets can be assembled with a waler on a concrete forming structure.

The reference numeral 10 indicates generally a prior art type of concrete forming structure. The prior art structure is shown in FIGS. 1 and 2 of the drawings attached herewith. It will be seen that FIGS. 1 and 2 are labeled with the legend "Prior Art". More specifically the concrete forming structure 10 includes conventional upright side-by-side forming panels 11 mounted on siderails 12. These panels are made in different ways but can comprise an aluminum sheet which is peripherally bounded on one side by a series of I-beams 13. When the panels 11 are placed in a side-by-side relation, then the side-by-side I-beams 13 on adjacent panels act together and are identified as siderails. The siderails are vertical structures and are positioned at horizontally spaced intervals along the length of the concrete forming structure. These I-beams and the siderails formed by the I-beams are provided with vertically spaced bushings 14 for receiving wedge bolts for securing the panels in side-by-side assembled relationship together. Where it is desired to add an alignment waler to the concrete forming structure, it has been the practice to use waler brackets 15 of the type shown in FIGS. 1 and 2. Lumber 16 can then be placed on the waler brackets to align the forms 17 of the concrete forming structure 10.

The waler brackets 15 each include a horizontal waler bracket leg 18 and an upright bracket leg 19. Lugs 20—20 are welded to opposite sides of the horizontal waler bracket leg 18 for securing the lugs 20,20 to the horizontal bracket leg 18. These lugs are formed so that they can have the bracket leg 18 positioned between the lugs 20,20 and so that the assemblage can abut against the vertical siderails 12. The construction of the bracket is such that the horizontal waler bracket leg 18 can extend rearwardly behind the lugs 20,20 and this bracket leg 18 has a hole 21 for receipt of round bolts 22 and a wedge pin 23 is provided for extending through a slot 24 in the round bolt. Thus, it will be seen that in the assembly of the waler bracket 15 with the concrete forming structure, that multiple parts are required and that an additional step is required to complete the assembly since the waler brackets 15 must be secured in place with wedge pins 23.

Now, in accordance with my invention, as shown in FIG. 3–10, I have provided a new and improved concrete forming structure 25. The structure 25 includes upright side-by-side forming panels 26 as previously described with the prior art structure 10 in FIGS. 1 and 2. Mounted on the panels 26 are siderails 27. The siderails comprise adjacent vertical I-beams 28 which are positioned in side-by-side relation with the panels when the panels are so positioned. The I-beams 28 have vertically spaced bushings 29. Wedge bolts and pin assemblies 30 can be used to secure adjacent siderails on adjacent panels in assembly together.

In accordance with my invention, where it is desired to provide an alignment waler on the concrete forming structure 25, my new and improved one piece waler brackets 31 can be used. Lumber 32 is adapted to be mounted on the brackets in a conventional way. These one piece brackets and the lumber provide alignment as indicated at 33.

Figure 3:
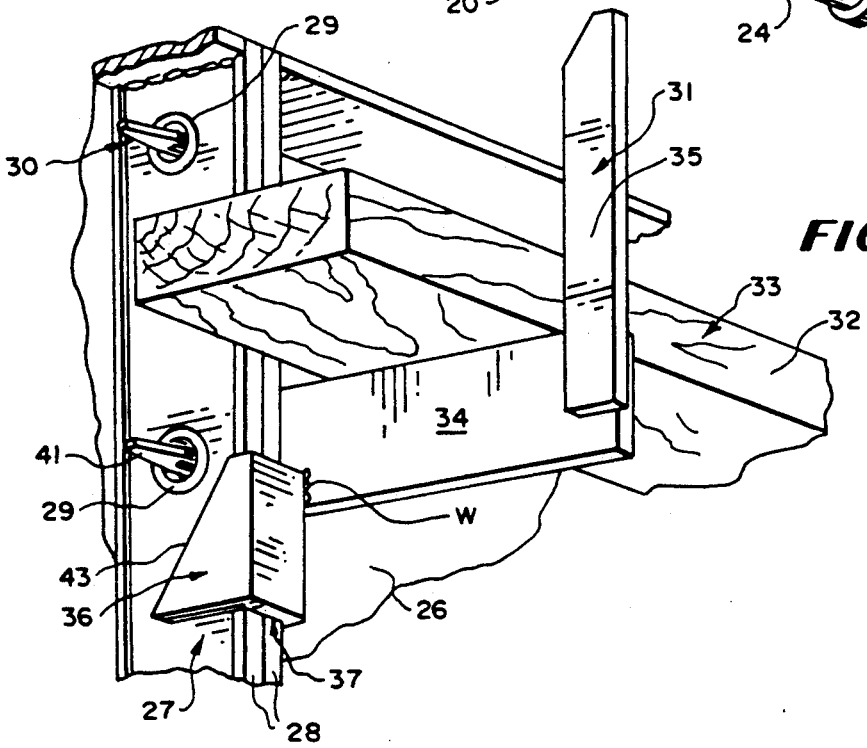
FIG. 3 is an enlarged perspective view of my new and improved concrete forming structure illustrating one side of my new and improved waler bracket for supporting alignment walers on the concrete forming structure.
Figure 4:
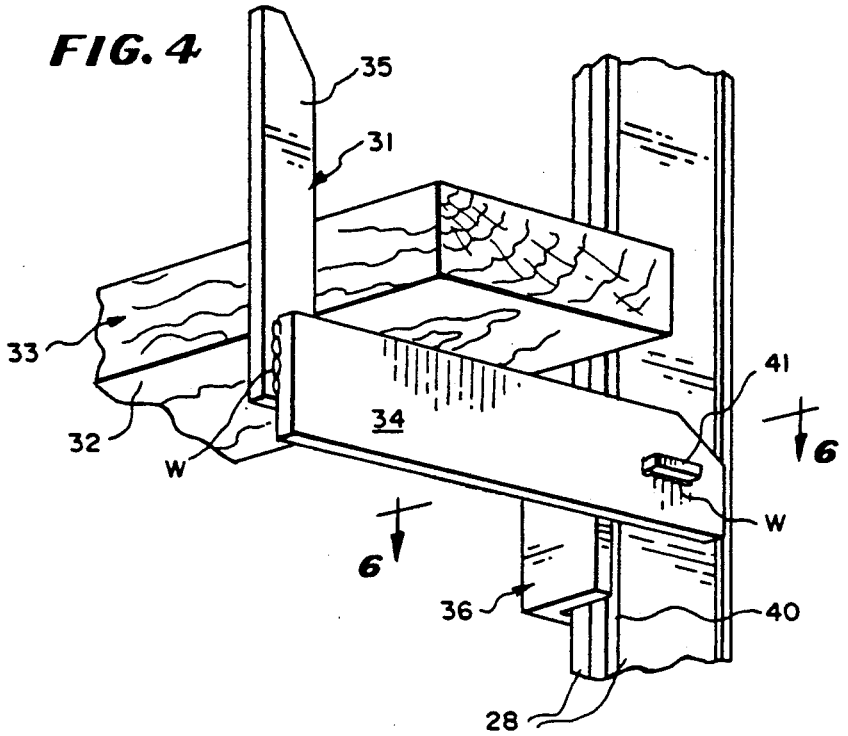
FIG. 4 is an enlarged fragmentary perspective view similar to FIG. 3 only showing the waler bracket from its opposite side.
Figure 5:
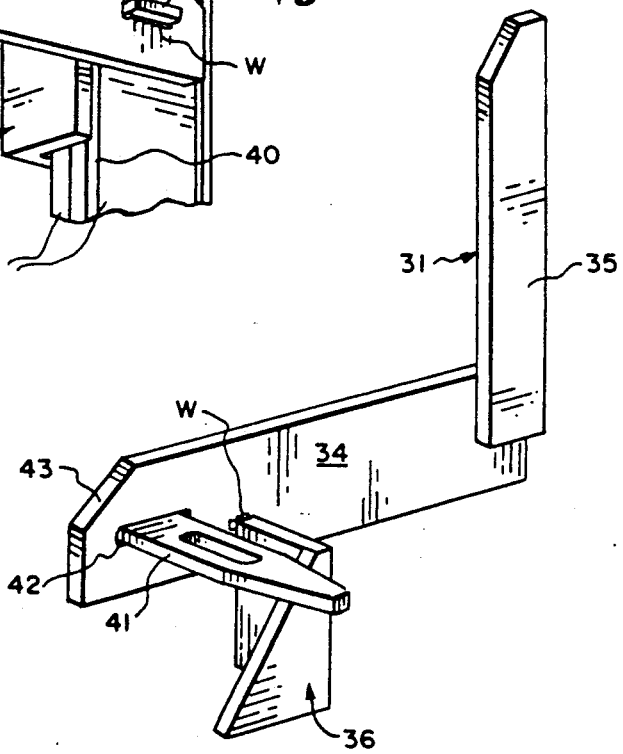
FIG. 5 is an enlarged perspective view of my new and improved waler bracket by itself.
Figure 6:
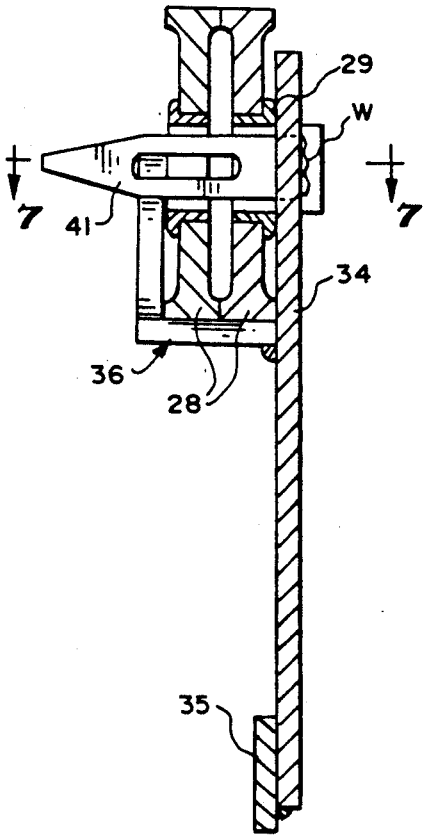
FIG. 6 is an enlarged vertical section taken on the line 6—6 looking in the direction indicated by the arrows as seen in FIG. 4.
Figure 7:
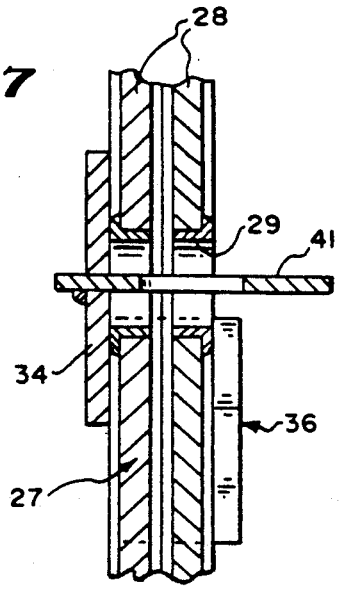
FIG. 7 is an enlarged fragmentary cross sectional view taken on the line 7—7 looking in the direction indicated by the arrows as seen in FIG. 6.

More specifically, my one piece waler brackets 31 include a horizontal waler bracket leg 34 and an upright waler bracket leg 35 which are secured in welded assembly together as indicated by the weld denoted at W (FIG. 4). All welded parts, as illustrated in the drawings, have the letter W applied thereto for identifying welds. In accordance with certain important features of my invention, an L-shaped angle bracket 36 is mounted upon the horizontal waler bracket leg 34 which bracket 36 has an upper corner edge **36*a* welded at W to a confronting lower inside surface 34*a* of the leg 34 as seen in FIGS. 3 and 5. This L-shaped angle bracket 36 co-acts with the leg 34 to provide a U-shaped rearwardly facing channel 37 as noted in FIG. 8–10, inclusive. By welding the upper corner edge 36*a* to the lower inside surface 34*a* of the leg 34, the angle bracket 36 can be located substantially beneath the leg 34 and the spaced bushings 29 so that the leg 34 can freely swing and be engaged with the siderails 27 in locked assembly therewith. This operation can be readily carried out by using only one hand by of the installer while the installer can use his other hand to hold onto a ladder thus enabling the one piece waler bracket 31 to be more safely installed with less chance for the installer to become injured. The angle bracket 36 co-acts with the horizontal waler bracket leg 34 to lock the waler bracket to the uprights 27 and no additional parts such as wedge pin 23 is required to be separately and independently attached to the wedge bolt 41 in contrast to the prior art shown in FIGS. 1 and 2 where the wedge pins 23 are needed to be secured with the wedge bolts 22 to lock the waler bracket 15 in assembly with the siderails 12. The channel 37 is adapted to engage with three edges of the siderails as indicated 38 (FIG. 10), 39 (FIG. 10)and 40 (FIG. 4**).

It will be observed that the one piece waler bracket 31 has a wedge bolt 41 that extends through a hole 42 in leg 34 and that the head end of the wedge bolt 41 is welded at W in fixed assembly with the leg 34. By securing the wedge bolt in unitary relation with the leg 34, the waler bracket 31 can be operated as a one piece structure in its assembly and disassembly with respect to the siderails 27 on a concrete forming structure 25. This is another feature of my invention.

The channel 37 and more particularly the L-shaped angle bracket 30 has a beveled face 43 and this face is beveled to provide clearance so that when the wedge bolt 41 is engaged in the bushing 29 the channel 37 can be readily engaged with the siderails 27 without interfering with the bushing 29 and the end of wedge bolt tapered end 44 that projects through the bushing as seen in FIG. 10.

The L-shaped angle bracket 30 has its outer angle bracket leg positioned to extend parallel to said horizontal waler bracket leg 34. The outer angle leg has its bevelled outer edge 43 spaced inwardly at its upper arm and from the wedge bolt 41 and has a lower end spaced in underlying relation beneath the wedge bolt 41 and has a lower and spaced in underlying relation beneath the wedge bolt 41 leaving a clearance between the L-shaped angle bracket thus allowing the waler bracket to freely rotate on the wedge bolt in the bushing so the waler bracket can rotate free of interference with the siderails as the channel is engaged and disengaged with the siderails associated therewith. The bevelled outer edge 43 is so constructed that when it is in assembly with the waler, its inner most lower edge portion is disposed vertically beneath the wedge bolt when the wedge bolt 41 is engaged in the bushing and the channel 37 is fully engaged with the siderails 27 to insure a firm connection between the bracket 30 and the siderails. These relationships are clearly shown in the drawings. It will be further seen that the channel has innermost edge areas engaged on opposite sides of the siderails 27 which edge areas are engaged about the siderails and beneath the wedge bolt 41 when the wedge bolt is engaged in the bushing 29 to ensure a solid connection between the channel 37 and the siderails 27.

Thus, when a worker is called upon to attach a waler 33 to the concrete form structure 25, a ladder is placed against the concrete forming structure, the worker then climbs the ladder and with one hand as shown in FIGS. 8–10 can readily assemble the one piece waler bracket 31 with the siderails 27. To this end, the worker using his right hand as seen in FIG. 8 aligns the end 44 of the wedge bolt 41 with the bushing opening 29 and then moves the wedge bolt through the bushing as shown in FIG. 9 in such a way that the leg 34 engages with its flat face in face to face contact with siderail surface 40 (FIG. 4). Then with the same hand, as shown by the arrows, the worker pivots the wedge bolt 41 in the bushing 29 in a downward direction thus causing the L-shaped angle bracket 36 and its channel 37 to be engaged about 3 sides of the siderail 27 with siderail surfaces 38, 39 and 40. To disassemble the waler bracket 31, the procedure can be reversed using the right hand of the worker to first lift the outer end of the horizontal bracket leg 34 and then to pull the wedge bolt 41 away from the bushing 29 so that the wedge bolt is disengaged from the bushing. Using this procedure, it is not necessary to use a second pin or wedge bolt to attach the wedge bolt 41 in place as would normally be expected. This prior practice is illustrated in FIGS. 1 and 2. Thus, my new and improved waler bracket can be effectively mounted and disassembled relative to siderails without requiring any additional fasteners.

The waler bracket may be comprised of any suitable material, and excellent results are obtainable where they are manufactured with a hot rolled steel of a general purpose type. Excellent results can be attained by manufacturing the bolt from C-1040 type steel.

While one embodiment of the invention has been described, the invention is not limited to the details set forth and other embodiments and modifications may come within and extend from the following claims:

I claim:

1. In a concrete forming structure for forming residential concrete where components thereof can be easily and quickly assembled on a job including a series of upright side-by-side positioned forming panels having a face sheet and I-beams secured thereto at margins of the face sheet with adjacent I-beams on adjacent panels coacting to act as siderails, the I-beams carrying vertically spaced bushings, and with the panels having wedge bolts extending through aligned bushings securing the panels in assembly together, the improvement comprising one piece waler brackets comprised of rolled steel mounted on the siderails in horizontally spaced relation for carrying horizontal lengths of lumber which comprise alignment walers, each of said waler brackets including a horizontal waler bracket leg and an upright bracket leg secured in fixed assembly to said horizontal waler bracket leg at a point spaced from an inner end of the horizontal waler bracket leg, an L-shaped bracket angle, a weld fixedly attaching said L-shaped bracket angle to said horizontal waler bracket leg with a first angle leg of said L-shaped bracket angle being substantially vertically disposed and extending to a side of the horizontal waler bracket leg, and a second angle leg of said L-shaped bracket angle extending rearwardly form said first angle leg, said second angle leg having a bevelled upper surface, said L-shaped bracket angle and said horizontal being cooperable to define a U-shaped rearwardly facing channel, said angle being engageable with the I beams, a wedge bolt, and a weld fixedly securing said wedge bolt to said horizontal waler leg inwardly of said channel with the wedge bolt being positioned rearwardly of said U-shaped rearwardly facing channel, the wedge bolt being extendable through one of said bushings and with said one piece waler bracket being rotatable in unison with said wedge bolt by using only one hand when the wedge bolt is engaged in said bushing to rotate said U-shaped rearwardly facing channel including said L-shaped bracket angle into engaged relation with an outer edge of said siderails in locked engagement with three confronting siderail faces of the siderails.

2. The structure of claim 1 wherein the wedge bolt is positioned above and rearwardly of where said L-shaped bracket angle is fixedly secured to said horizontal waler bracket leg.

3. The structure of claim 2 wherein said L-shaped bracket angle extends beneath said horizontal waler bracket leg thereby vertically extending the effective length of the U-shaped channel for locking engagement with said siderails.

4. The structure of claim 3 wherein said second angle leg extends parallel to said horizontal waler bracket leg, said bevelled upper surface having an upper end and a lower end, said bevelled upper surface having said lower end spaced beneath in underlying relation relative to said wedge bolt leaving a clearance between the L-shaped bracket angle allowing the waler bracket to freely rotate on said wedge bolt in the bushing free of interference with the siderails associated therewith.

5. The structure of claim 1 further characterized wherein said weld securing said L-shaped bracket angle to said waler bracket leg is located at an upper corner of said L-shaped bracket angle and is joined with a confronting upright surface of said horizontal waler bracket leg, thus enabling said L-shaped bracket angle to extend substantially beneath said horizontal waler bracket leg and said bushing so that the L-shaped bracket can be rotated into assembly with the siderails without interference between the L-shaped bracket and the wedge bolt and the bushing.

6. In a concrete forming structure for forming residential concrete where components thereof can be easily and quickly assembled on a job including a series of upright side-by-side positioned forming panels having a face sheet and I-beams secured thereto at margins of the face sheet with adjacent I-beams on adjacent panels co-acting to act as siderails, the I-beams carrying vertically spaced bushings, and with the panels having wedge bolts extending through aligned bushings securing the panels in assembly together, the improvement comprising one piece waler brackets comprised of rolled steel mounted on the siderails in horizontally spaced relation for carrying horizontal lengths of lumber which comprise alignment walers, each of said one piece waler brackets including a horizontal waler bracket leg and an upright bracket leg secured in fixed assembly to said horizontal waler bracket leg at a point spaced from an inner end of the horizontal waler bracket leg, an L-shaped bracket angle fixedly attached to said horizontal waler bracket leg and cooperable therewith to define a U-shaped rearwardly facing channel, said L-shaped bracket angle having a first angle leg substantially vertically disposed and extending to a side of the horizontal waler bracket leg and a second angle leg of said L-shaped bracket angle extending rearwardly from said first angle leg, said second angle leg having a bevelled upper surface, and a wedge bolt fixedly secured to said horizontal waler leg inwardly of said channel with the wedge bolt being positioned rearwardly of said U-shaped rearwardly facing channel, the wedge bolt being extendable through one of said bushings and with said one piece waler bracket being rotatable in unison with said wedge bolt when the wedge bolt is engaged in said bushing to rotate said U-shaped rearwardly facing channel into engaged relation with an outer edge of said siderails in locked engagement with three confronting siderail faces of the siderails, the wedge bolt being positioned above and rearwardly of where said L-shaped angle is fixedly secured to said horizontal waler bracket leg, said L-shaped angle extending beneath said horizontal waler bracket leg thereby vertically extending the effective length of the U-shaped channel for locking engagement with said siderails.

7. The structure of claim 6 wherein said second angle leg extends parallel to said horizontal waler bracket leg, said bevelled upper surface having an upper end and a lower end, said bevelled upper surface being spaced inwardly at the upper end from the wedge bolt and having said lower end spaced beneath in underlying relation relative to said wedge bolt leaving a clearance between the L-shaped angle allowing the waler bracket to freely rotate on said wedge bolt in the bushing free of interference with the siderails associated therewith.

8. The structure of claim 6 further characterized wherein said L-shaped bracket angle is joined to said waler bracket leg by a weld, said weld being located at an upper corner of said L-shaped bracket angle forming a confronting upright surface of said horizontal waler bracket leg to said upper corner, thus enabling said L-shaped bracket angle to extend beneath said horizontal waler bracket leg and said bushing so that the L-shaped bracket can be rotated into assembly with the siderails without interference between the L-shaped bracket and the wedge bolt and the bushing.

9. A one piece welded waler bracket assembly for mounting on an I-beam in horizontally spaced relation to other waler bracket assemblies for carrying horizontal lengths of lumber which provide alignment, said waler bracket assembly being comprised of rolled steel including a horizontal waler bracket leg and an upright bracket leg secured in fixed welded assembly to said horizontal waler bracket leg at the point spaced from an inner end of the horizontal waler bracket leg, an L-shaped angle welded in fixed assembly with said horizontal waler bracket leg and cooperable therewith to define a U-shaped rearwardly facing channel, said L-shaped angle having a first angle leg substantially vertically disposed and extending to a side of the horizontal waler bracket leg and a second angle leg extending rearwardly from said first angle leg, said second angle leg having a bevelled upper surface, and a wedge bolt fixedly secured by a weld to said horizontal waler leg inwardly of said channel with the wedge bolt being positioned rearwardly of said U-shaped rearwardly facing channel, the wedge bolt being extendable through a bushing on a waler and with said one piece waler bracket being rotatable in unison with said wedge bolt when the wedge bolt is engaged in a bushing to rotate said U-shaped rearwardly facing channel for locked engagement with three confronting siderail faces of siderails, the wedge bolt being positioned above and rearwardly of where said L-shaped angle is fixedly secured to said horizontal waler bracket leg.

10. The bracket of claim 9 wherein said L-shaped angle extends beneath said horizontal waler bracket leg thereby vertically extending the effective length of the U-shaped channel for locking engagement with siderails.

11. The bracket of claim 10 wherein said second angle leg extends parallel to said horizontal waler bracket leg, said bevelled upper surface having an upper end and a lower end, said bevelled upper surface being spaced inwardly at the upper end from the wedge bolt and having said lower end spaced beneath in underlying relation relative to said wedge bolt leaving a clearance between the L-shaped angle allowing the waler bracket to freely rotate on said wedge bolt in a bushing free of interference with siderails when associated therewith.

12. The bracket of claim 9 wherein said horizontal waler bracket leg has a hole in it and with said wedge bolt being extended through said hole, and means fixedly attaching said wedge bolt and said horizontal waler bracket leg in fixed engagement together.

13. In a concrete forming structure for forming residential concrete where components thereof can be easily and quickly assembled on a job including a series of upright side-by-side positioned forming panels having a face sheet and I-beams secured thereto at margins of the face sheet with adjacent I-beams on adjacent panels coacting to act as siderails, the I-beams carrying vertically spaced bushings, and with the panels having wedge bolts extending through aligned bushings securing the panels in assembly together, the improvement wherein one piece waler brackets comprised of rolled steel are mounted on the siderails in horizontally spaced relation for carrying horizontal lengths of lumber which comprise alignment walers, each of said waler brackets including a horizontal waler bracket leg and an upright bracket leg secured in fixed assembly to said horizontal waler bracket leg at a point spaced from an inner end of the horizontal waler bracket leg, an L-shaped bracket angle, means fixedly attaching the L-shaped bracket angle to said horizontal waler bracket leg and cooperable therewith to define a U-shaped rearwardly facing channel for locking co-action with three sides of said siderails, said L-shaped bracket angle having a first angle leg substantially vertically disposed and extending to a side of the horizontal waler bracket leg and a second angle leg of said L-shaped bracket angle extending rearwardly from said first angle leg, said second angle leg having a bevelled upper surface, and a wedge bolt fixedly secured to said horizontal waler leg inwardly of said channel with the wedge bolt being positioned rearwardly of said U-shaped rearwardly facing channel and telescoped in the bushing, said one piece waler bracket being rotatable in unison with said wedge bolt is engaged in the bushing to rotate said U-shaped rearwardly facing channel free of the siderails for disengaging the waler bracket channel, then moving the wedge bolt sidewise out of engagement with the bushing to disassemble the one piece waler bracket from the siderails.

14. The structure of claim 13 wherein said L-shaped bracket angle extends beneath said horizontal waler bracket leg thereby vertically extending the effective length of the U-shaped channel for locking engagement with said siderails.

15. The structure of claim 13 wherein the wedge bolt is positioned above and rearwardly of where said L-shaped bracket angle is fixedly secured to said horizontal waler bracket leg.

16. The structure of claim 13 wherein said second angle leg extends parallel to said horizontal waler bracket leg, said bevelled upper surface having an upper end and a lower end, said bevelled upper surface being spaced inwardly at the upper end from the wedge bolt and having said lower end spaced beneath in underlying relation relative to said wedge bolt leaving a clearance between the L-shaped bracket angle allowing the waler bracket to freely rotate on said wedge bolt in the bushing free of interference with the siderails associated therewith.

17. The structure of claim 13 wherein said horizontal waler bracket leg has a hole in it and with wedge bolt being extended through said hole, and means fixedly attaching said wedge bolt and said horizontal waler bracket leg in fixed engagement together.

18. The structure of claim 13 wherein said second angle leg extends parallel to said horizontal waler bracket leg, said bevelled upper surface being spaced inwardly at the upper end from the wedge bolt and having said lower end spaced beneath in underlying relation relative to said wedge bolt leaving a clearance between the L-shaped angle bracket thus allowing the waler bracket to freely rotate on said wedge bolt in the bushing so the waler bracket can rotate free of interference with the siderails as the channel is engaged and disengaged with the siderails associated therewith, said bevelled upper surface being so constructed with an inner most lower edge portion being disposed vertically beneath the wedge bolt when the wedge bolt is engaged in the bushing and the channel is fully engaged with the siderails to insure a firm connection between the bracket and the siderails.

19. The structure of claim 13 wherein the channel has innermost edge areas engageable on opposite sides of the siderails which edge areas are engaged about the siderails above and beneath the wedge bolt when the wedge bolt is engaged in the bushing to ensure a solid connection between the channel and the siderails.

20. The structure of claim 13 further characterized wherein said L-shaped bracket angle is secured to said waler bracket leg by a weld, said weld being located at an upper corner of said L-shaped bracket angle to join a confronting upright surface of said horizontal waler bracket leg to said upper corner, thus enabling said L-shaped bracket angle to extend beneath said horizontal waler bracket leg and said bushing so that the L-shaped bracket can be rotated into assembly with the siderails without interference between the L-shaped bracket and the wedge bolt and the bushing.

* * * * *